United States Patent [19]

Song et al.

[11] Patent Number: 5,022,566

[45] Date of Patent: Jun. 11, 1991

[54] PRESS-OPEN SIDE DISPENSING CLOSURE

[75] Inventors: John S. Song, Evanston; Richard W. Hofman, Chicago, both of Ill.

[73] Assignee: Magenta Corporation, Chicago, Ill.

[21] Appl. No.: 485,294

[22] Filed: Feb. 26, 1990

[51] Int. Cl.[5] ..... B67D 3/00

[52] U.S. Cl. ..... 222/480; 222/556

[58] Field of Search ..... 222/532, 535, 565, 558, 222/480, 556, 517, 540; 215/235, 237, 238

[56] References Cited

U.S. PATENT DOCUMENTS

| | | | |
|---|---|---|---|
| 2,361,958 | 11/1944 | Nyden | 222/480 X |
| 3,303,971 | 2/1967 | Stevens, Jr. | 222/532 X |
| 3,404,815 | 10/1968 | Porter | 222/535 X |
| 3,739,957 | 6/1973 | Alpern | 222/556 O |
| 3,853,250 | 12/1974 | Alpern | 222/556 X |
| 4,010,875 | 3/1977 | Babiol | 222/517 O |
| 4,558,806 | 12/1985 | Shabram, Sr. et al. | 222/556 O |
| 4,775,065 | 10/1988 | Shastal | 222/517 X |
| 4,776,501 | 10/1988 | Ostrowsky | 222/556 X |
| 4,962,869 | 10/1990 | Gross et al. | 222/556 X |

FOREIGN PATENT DOCUMENTS

| | | | |
|---|---|---|---|
| 1317751 | 1/1963 | France | 222/556 |
| 2609000 | 7/1988 | France | 222/565 |
| 2222154 | 2/1990 | United Kingdom | 222/556 |

*Primary Examiner*—Michael S. Huppert
*Assistant Examiner*—Anthoula Pomrening
*Attorney, Agent, or Firm*—Laff, Whitesel, Conte & Saret

[57] ABSTRACT

A one-piece side dispensing closure for powdered, granular or particulate materials. The closure is molded from plastic and has a press-open dispensing lid.

7 Claims, 3 Drawing Sheets

PRESS-OPEN SIDE DISPENSING CLOSURE

BACKGROUND OF THE INVENTION

The present invention relates to a plastic closure and more particularly to a press-open side dispensing closure for the dispensing of powdered, granular particulate materials.

The closure is an end press-open side dispensing closure economically produced as a one piece molded plastic closure.

There are numerous examples of molded plastic closures which are used to dispense particulate materials. These closures normally provide for dispensing from the top of the closure and are not side dispensers. However, one piece side dispensing closures for particulate material are well known. These are evidenced by the closures of U.S. Pat. No. 3,469,732 which shows a cover for a condiment container having a side dispensing closure. The closure has a lid being pivotally connected to the top of the closure by a living hinge and the lid has a nail or thumb access piece used to lift the lid. The lid has an arcuate dispensing front wall which extends the width of the cover. The arcuate dispensing front wall has a plurality of holes for dispensing product stored in the container. The arcuate dispensing front wall extends downward from the lid into the container through the upper surface of the cover to prevent the product from escaping except through the holes. Capture or stop means on the arcuate dispensing front wall prevents the lid from being lifted beyond a predetermined extent.

U.S. Pat. No. 3,302,835 discloses a combined shaker dispenser and closure adapted to be positioned within an opening in a container, for example, in an opening in the planar top cover of a cylindrical drum. The closure includes a triangular lid section with the apex of the triangle pointing toward the perimeter edge of the cover. The triangular lid section is pivotally connected to the cover along the base of the triangle. A pair of wall sections extending downward from the lid section into the container run from the base of the triangle to the apex where they intersect. As the lid section pivots, the wall sections are maintained in contact with the perimeter of the opening. A plurality of grooves in the wall sections form vertical channels therein to permit product to dispense when the lid section is in a raised position. The lid section includes a flange-like extension beyond the boundaries of the opening to prevent the product from escaping when the lid section is in its closed position and to permit the user to displace the lid section from the closed position.

A common flaw of the aforementioned closures is that they are difficult to operate using only one hand. Many activities leave only one hand free to open a container and apply the stored product. This flaw is especially troublesome in food and medical applications, where it is desired to keep the container closed except when dispensing to avoid contamination. For example, in food preparation, it may be necessary to dispense items from containers while continuously stirring food in a pan. Similarly, when applying a powdered product to an infant's body (such as when changing a diaper), it may be necessary to hold the infant continuously with one hand. It is often inconvenient to predict the need for the product and prepare the container in advance.

There are a number of reasons why prior art closures are difficult to operate using only one hand. Many are designed to rest flush with the upper surface of the container cover when in the closed position and provide a small tab as the exclusive means for operating the closure. A small cavity is sometimes provided under the tab. The user must insert a finger nail or other thin object into the slit under the tab and apply pressure to pry the closure up into the dispensing position. Ordinarily, a user will secure the container with one hand, and pry with the other hand. It is difficult (and even impossible with some closures) to simultaneously secure the container and pry the closure up. In addition, even with two hands, attempting to operate the closure may cause discomfort or injury to users with long or fragile finger nails.

Closures which are conveniently operated with one hand have been developed in the past, but are more difficult and expensive to manufacture and are poorly adapted for dispensing powdered and particulate products. For example, a known two-piece molded closure suitable for shampoos and other viscous liquid products includes a moving lid piece pivotally connected to a fixed base piece, the moving lid piece having stable open and closed positions. The closure is opened or closed by pressing down on the lid piece on the appropriate side of the pivot points. The fixed base piece has a cylindrical fluid channel for carrying fluid from the container to the lid piece, and the lid piece has a perpendicular fluid channel for carrying fluid from the base piece to a dispensing orifice. In the closed position, a sealing means located in the moving lid piece channel engages the outlet of the base piece fluid channel to prevent fluid flow. In the open position, the sealing means is moved away from the base piece channel to permit fluid to flow therefrom into the lid piece channel for dispensing through the orifice.

This closure is poorly adapted for dispensing particulate and powdered products. Because the fluid channels are long compared to their diameter and because of the perpendicular bend in the channel, the dispensation rate of such products is unacceptably low, the product is readily compacted into the channels, and the channels are easily clogged. Also, product remaining in the channels prevents the lid piece seal from properly engaging the base piece channel, preventing the lid piece from being moved to its closed position. Another problem with this closure is the need for producing two separate pieces and additional manufacturing step of assembling the pieces to form a complete unit.

Thus, there exists the need for an improved side-dispensing closure for particulate or powdered products which is easy and comfortable to operate using only one hand.

It is therefore an object of the present invention to provide a side-dispensing closure for particulate or powdered material having a pivotal push open lid and a plurality of dispensing openings.

It is a further object of the invention to provide a press-open side-dispensing closure adapted for convenient one-hand operation, which closure may be economically manufactured by molding as a single piece.

SUMMARY OF THE INVENTION

The present invention provides a container closure cap adapted for dispensing particulate, granular, or powdered materials which has a push open dispensing lid. The cap is preferably manufactured as a one-piece molded plastic cap. The cap has a fixed base portion and a moving press-open dispensing lid pivotally connected to the base. In the most preferred embodiment, the pivotal connection between the lid and the base is provided by a pair of living hinges. The lid has a substantially flat top lid wall, a pair of depending side walls, a depending arcuate front dispensing wall, and a depending curved rear sealing wall. The fixed base portion has a substantially flat top end wall, a skirt bounding the top end wall which has internal means to attach the cap to the container. The skirt has a substantially cylindrical first outer wall. In a preferred structure, the base is shaped hat-like and has a cylindrical second outer wall above the first outer wall, and a flat intermediate wall joining the first and second outer walls. The lid portion resides and pivots in a cavity formed in the top end wall of the base.

The living hinges join the top end wall of the base with the lid. The lid has a relatively stable open position and a relatively stable closed position. The lid pivots between these positions about an axis defined by the two living hinges. The front dispensing wall has a plurality of dispensing orifices for dispensing product therethrough. In the closed position, a top wall of the lid is substantially flush with the top end wall of the base, and the dispensing orifices of the front dispensing wall are covered by the first outer wall of the base, to prevent product from being dispensed. In the open position, the front side of the lid top wall extends above the base top wall, and the front wall dispensing orifices are uncovered, to permit product to be dispensed by pouring or shaking the contents of the container. A stop means on the front dispensing wall prevents the lid from being opened beyond the bottom of the dispensing wall.

Friction holds the lid open. However, appropriate beading may also be used on the closure to hold the lid open for dispensing or closed. The user may move the lid to its open position by pressing down on the rear of the lid top wall. The user may close the cap by pressing down on the front of the lid top wall. Thus the user may hold the container in one hand and easily open and close our closure cap using the same hand; it is not necessary to pry the lid open using the finger nail or other flat tool.

A preferred closure cap according to the invention also includes a number of features to improve performance when used with particulate, granular, and powdered material. It is desired that such materials dispense easily, but only from the intended dispensing orifices. Thus, the base portion of the closure cap includes a front cantilevered sealing means which wipes against the front dispensing wall and if desired, against the depending side walls of the lid to prevent undesired leakage of product between the front dispensing wall and the base portion first outer wall. The lid further includes a back wall which is a flexible hinged seal section which wipes against a flat sealing surface formed by the base section intermediate wall. This minimizes undesired leakage. The depending side walls of the lid conform to the shape of a section of the exterior surface of a cone, causing them to wipe against opposing surfaces of the base and, if desired, the cantilevered seal. This further prevents undesired leakage of product and provides a friction contact to aid in maintaining the lid in an open or closed position.

In contrast to the prior art press-to-open closures, which require the product to travel through lengthy, narrow channels including perpendicular bends, the present invention provides direct shake dispensing outlets for the product through the dispensing orifices when the lid is in the open position. The orifice which joins the container contents to the dispensing orifices is large compared to the pour orifices of some prior art press open dispensing caps. This minimizes compaction of product near the dispensing orifices. The joining orifice is substantially the same size as the container opening and this reduces clogging which is characteristic of the aforementioned prior-art press-to-open closures.

A plurality of reinforcing rib members join the front dispensing wall to the top wall of the lid portion. The reinforcing members extend longitudinally a substantial distance along the lid portion to provide rigidity when the lid is opened or closed. In order to secure and seal the inventive closure cap to the container, the base portion second outer cylindrical wall includes an interior capture lip means which engages a mating exterior capture lip means on the outer cylindrical container surface. These capture means preferably extend around the entire cylindrical surfaces of the container and base portion to provide a sealing function, thereby further preventing product leakage and contamination. The base portion first outer cylindrical wall extends below the intermediate wall a small distance into the container to minimize deformation of the container. This helps prevent the closure cap from being inadvertently disengaged from the container.

Thus, this invention provides an improved press-open closure cap for shake dispensing particulate, granular, or powdered products.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DETAILED DESCRIPTION OF THE PREFERRED EMBODIMENTS

Figure 1:
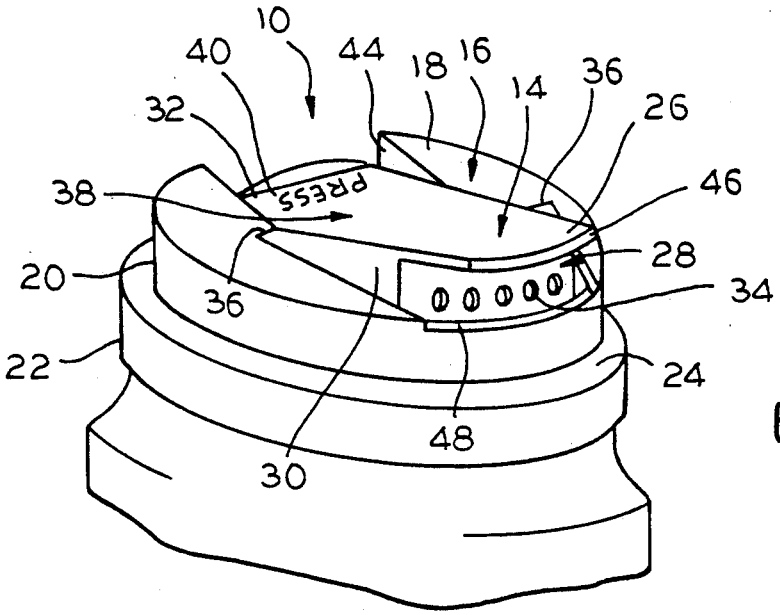
FIG. 1 is a fragmentary perspective view of a container equipped with a closure cap according to the invention with the dispensing lid in an open position.

Referring to FIGS. 1-8 generally, with particular attention to FIG. 1, there is shown a closure cap 10 according to the invention installed on a substantially cylindrical container 12. The cap 10 is preferably made of one-piece molded plastic. Any suitable plastic may be used. The plastic we use is a polypropylene. While certain parts are described herein as substantially cylindrical or substantially flat, one skilled in the art will appreciate that in order to permit the mold to release the part, a small amount of draft, or slimming of the part in the direction opposite part movement upon release, is required.

The closure cap 10 has a press-open lid 14 and a fixed portion 16. The fixed portion has a substantially flat top end wall 18, a substantially cylindrical first outer wall 20 extending downwardly from the outer periphery of the top wall 18, a substantially cylindrical skirt or second outer wall 22 concentric with the first outer wall 20 and having a larger diameter than the first outer wall 20 and extending below the first outer wall 20. A flat intermediate wall or shoulder 24 which is substantially parallel to the top end wall 18, angularly connects the first and second outer walls 20, 22.

Figure 5:
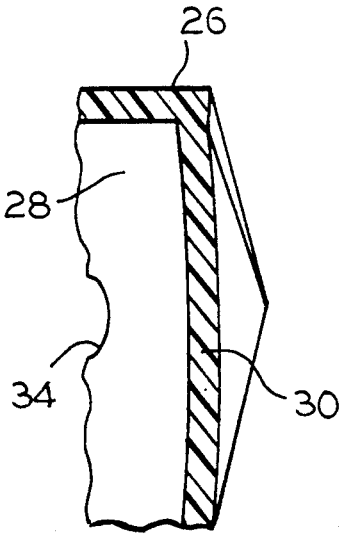
FIG. 5 is an enlarged fragmentary sectional view taken from the front of the container closure of a sidewall of the hinged portion substantially along the lines 5—5 of FIG. 4.

The press-open lid 14 has a substantially flat lid top wall 26, an arcuate front dispensing wall 28, and side walls 30 which are sections of a cone as best seen in FIG. 5.

Figure 2:
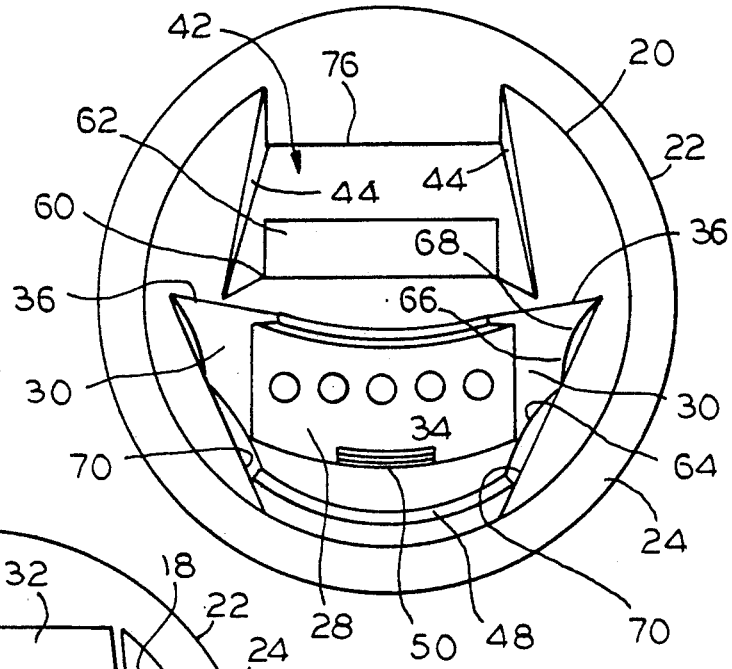
FIG. 2 is a top plan view of the closure cap of FIG. 4 showing the dispensing lid in an upright position.
Figure 2A:
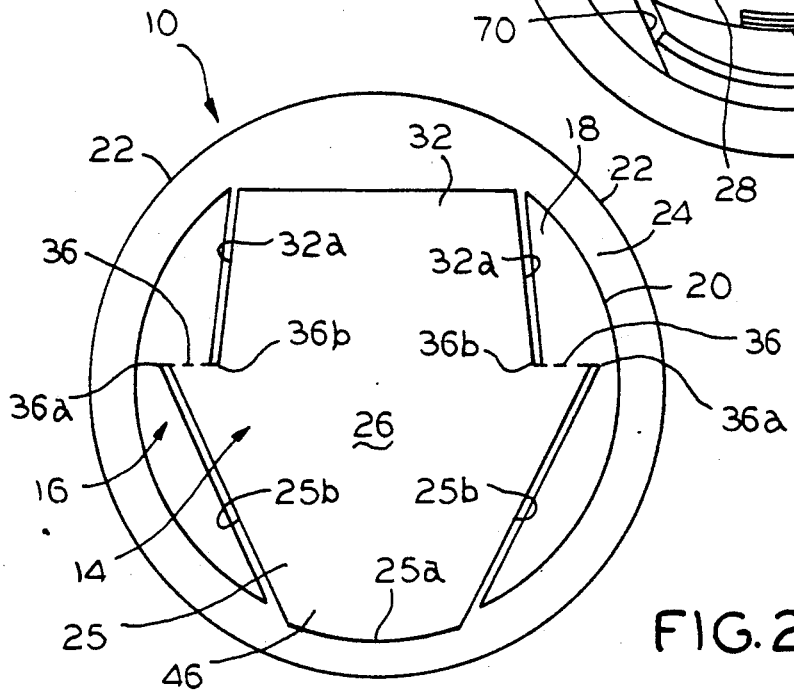
FIG. 2*a* is a reduced top plan view of the closure cap of FIG. 1 in a closed position.
Figure 3:
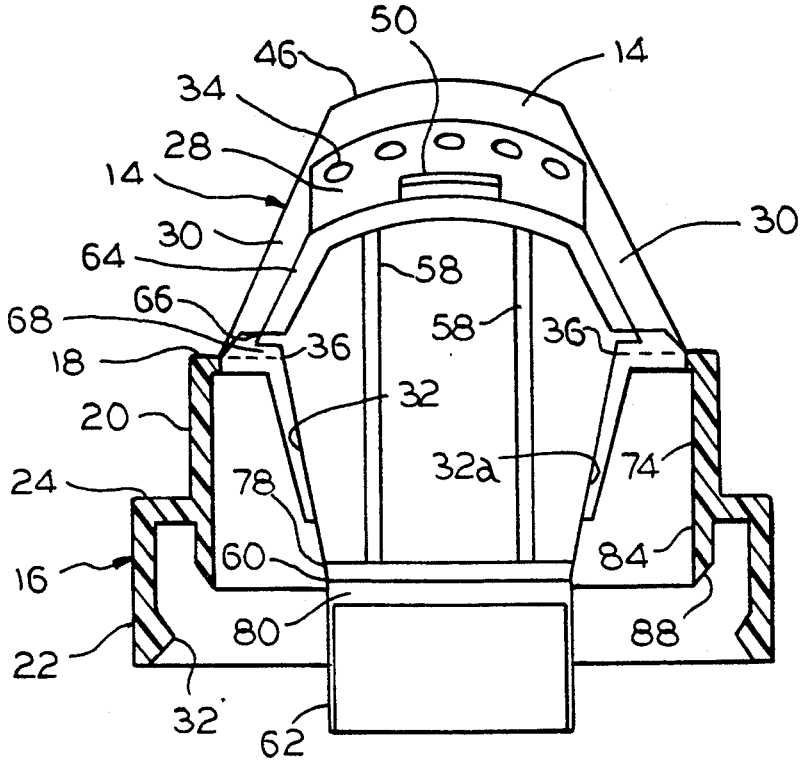
FIG. 3 is a part side elevation view, part cross-sectional view taken along the lines 3—3 of FIG. 2.

The press-open lid 14 is shown in FIG. 1 its open side dispensing position. The flat lid top wall 26, FIG. 2A, has a trapezoidal-like dispensing head 25. The short end or curved front end 25*a* of the trapezoidal head is arcuate and forms a lip. A pair of diverging sides 25*b* diverge from the ends of the front end 25*a* to the outside ends 36*a* of a pair of living hinges 36. Extending equidistant from the ends of the base of the trapezoidal dispensing head is a trapezoidal press section 32 with the base of the trapezoidal press section being adjacent or coextending with the base of the trapezoidal dispensing head. The press section 32 has a pair of converging sides 32*a* converging from the inner ends 36*b* of the living hinges 36. An arcuate front dispensing wall 28 extends radially (curves) downwardly from the bottom surface of the trapezoidal head a predetermined distance in from the end 25*a*. The front dispensing wall also is arcuate and extends between the trapezoidal head side walls 30. The front dispensing wall may be considered as having the shape of a segmented spherical wall.

A pair of side walls 30 extend downwardly from head sides 25*b*. The side walls 30 as shown in detail in FIG. 5 are a segmented conical shape with the base of the segmented cone being joined to the front dispensing wall 28.

The side walls are bowed outwardly slightly along a height of the walls to maintain the outer surfaces of the walls in sealing contact with the corresponding divergent opening sides in the top end wall 18 and/or sealing contact with a cantilever seal as hereinafter described. The front dispensing wall 28 has a plurality of orifices 34 to permit product to be dispensed. In its closed position, lid top wall 26 is substantially flush with the top end wall 18. The front dispensing wall 28 and dispensing orifices 34 are obscured by first outer wall 20, and prevent dispensation of product. The lid 14 is pivotally attached to fixed base portion 16 and top end wall by a pair of living hinges 36. The use of living hinges permits the entire cap to be molded as a single integrated piece entirely of plastic.

A press-open area 32 forms the rear section of dispensing lid 14 and extends from the hinge 36 as explained above. An appropriate legend 40, such as the word "PRESS" (FIG. 1), is preferably displayed on the press-open area 32 to identify that area to consumers who may be unfamiliar with the operation of the cap. When downward pressure is applied to area 32, lid 14 pivots on hinge 36, raising the front dispensing section 25 to the open position and exposing front dispenser wall 28 and dispensing orifices 34.

The lid 14 resides in a cavity 42 (FIG. 2) in the base 16. The rear of the cavity is shaped to accommodate the pivoting of press section 32. The cavity has interior side walls 44 extending downward to guide the rear section of lid 14 as it pivots and to prevent escape of product from the gap which would form between top walls 26 and 18 if not for side walls 44. The side walls 44 are preferably flexible and have a curved shape to allow a seal contact between side walls 44 and the sides 32*a* of press-open lid 32.

Downward pressure applied to the front section 25 of the press-open lid causes it to pivot to the closed position. The front section has a small tab extension 46 integrally extending from the top wall 26. The tab extension 46 overlaps the first outer wall 20. A small indentation 48 in the outer wall 20 is provided to accommodate tab extension 46 when the lid portion 14 is in its closed position. This permits lid 14 to lie flush with base top wall 18 when the lid is closed. The tab extension 46 acts as a stop means, preventing lid portion 14 from pivoting too far in the closed direction.

Referring now to FIGS. 2–6, the inventive closure cap 10 will be discussed in greater detail. The pivotal lid 14 appears in a raised non-operating upright position for clarity. In normal circumstances, once the cap 10 is attached to a container !2, the lid 14 is maintained between its open and closed positions by stop means 50 and friction engagement. Stop means 50 is preferably a slightly protruding lip extending outward at the bottom of the front dispensing wall 28 below orifices 34. Stop 50 engages an opposing seal 52 (FIG. 4) which extends inwardly from first outer wall 20 to prevent upward travel of the lid 14 beyond the coverage provided by front dispensing wall 28. Stop means 50 extends along only a portion of the arcuate front dispensing wall 28. Its size is sufficient to engage seal 52 without producing enough localized stress to damage the seal. The bottom surface 54 of stop 50 is angled or chamfered to facilitate displacement of the lid 14 from a raised position shown in FIGS. 2–6 to the normal range of positions as shown in FIG. 1. The top surface 56 of stop 50 is flat so that once displaced to the normal range of position, it would be difficult to force the stop 50 past seal 52.

Seal 52 also functions to seal the front dispensing wall 28 to the first outer wall of the base 16, thereby preventing contamination and undesired escape of product between these components. Seal 52 is a cantilever which extends angularly inward toward the center of the first wall 20 and downward from the first outer wall 20 along the width of front dispensing wall 28. The cantilever extends at an angle of from about 10° to about 45° from the vertical axis. Seal 52 is flexibly urged onto wall 28 so that the seal is maintained even if lid portion 14 or outer wall 20 are slightly distorted. The front dispensing wall 28 conforms to the shape of a partial sphere and wall 28 is centered between hinge 36, so that seal 52 remains urged in continuous contact with front dispensing wall 28 as the lid 14 is pivoted between its open and closed positions.

Lid 14 has a plurality of structural reinforcing ribs 58 which extend rearward from front dispensing wall 28 to terminate near hinge 60 (discussed hereinafter in greater detail). Ribs 58 provide structural rigidity for the lid 14 while providing relatively unencumbered product flow to front dispensing wall 28. In particular, ribs 58 prevent excessive deformation of lid 14 when pressure is applied by the user to open or close the lid. In addition, ribs 58 also prevent undesired inward deformation of front dispensing wall 28. The rearmost edges of ribs 58 preferably taper radially to match the preferred shape of seal segment 62 (discussed hereinafter in greater detail).

Figure 4:
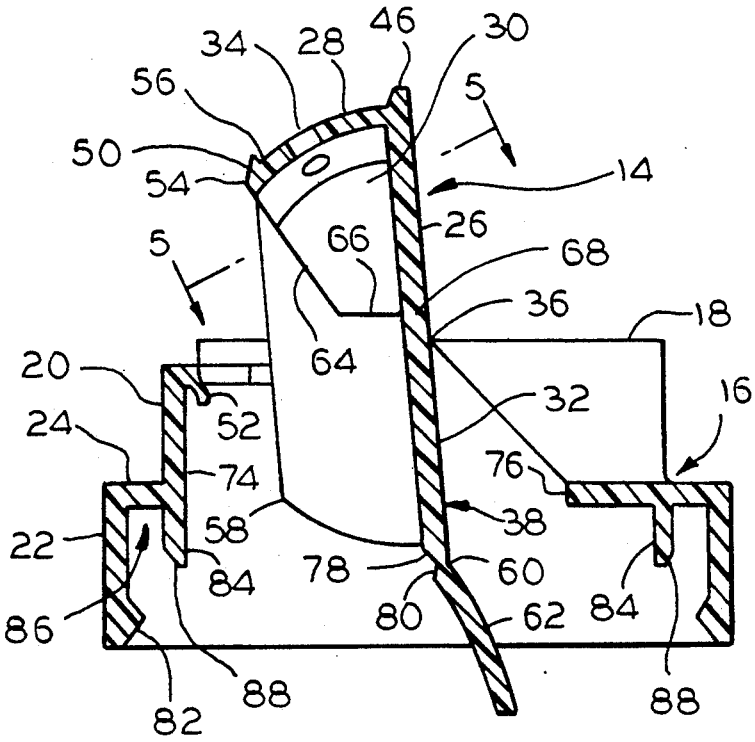
FIG. 4 is a part side elevation view, part cross-sectional view taken along the lines 4—4 of FIG. 2.
Figure 6:
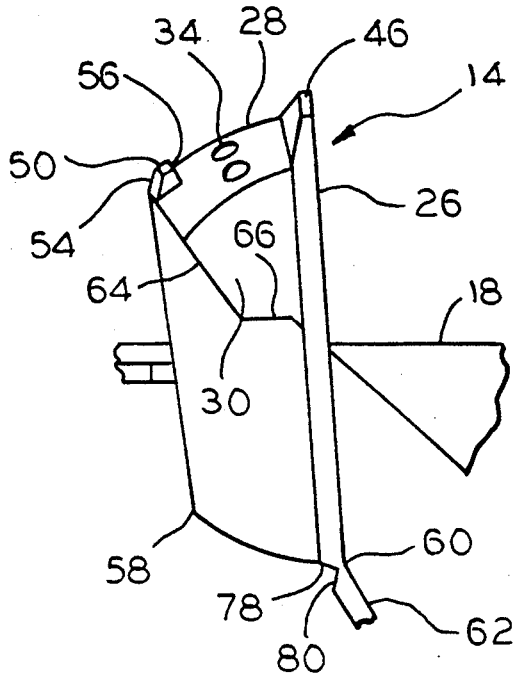
FIG. 6 is a partial plan view of the dispensing lid of FIG. 4.

Referring to FIGS. 4 and 6, the lid side walls 30 as viewed in a plan view taper rearward from front dispensing wall 28 to terminate near hinge 36. At their intersections with front dispensing wall 28, side walls 30 extend downward from top wall 26 to a depth equal to that of the front wall 28. The walls 30 taper upward at a modest angle at section 64, taper at a sharp angle at section 66, and return to a modest angle at section 68. At the end of section 68, the walls terminate entirely to prevent interference with the operation of hinge means 36. Side walls 30 and top wall 26 thus provide a chute-like structure to direct product to the orifices 34 of the front dispensing wall 28. As shown in FIG. 5, side walls 30 preferably conform to the shape of a conical surface such that the walls 30 are bowed outwardly slightly. This maintains the outer surface of the side walls 30 in tight sealing contact with the opposing interior side 70 of base 16 throughout all normal positions of lid portion 14, thereby preventing product leakage and contamination. If desired, the seal 52 may be lengthened to extend along the interior of sides 70 a predetermined distance below the top surface to provide continuous seal engagement with walls 30.

The press section 32 of the pivotal lid to rear of hinges 36 further has a rear wall 62. The rear wall 62 is curved and is hinged at 60 to the rear end of press section 32. As shown in FIG. 4, the rear wall is biased towards the top surface of lid 14. That is when the rear wall 62 is free, it may project above the top surface 32. When lid 14 is in its normal position range, FIGS. 7 and 8, rear wall 62 flexes and acts as a seal. The rear wall 62 rests on rear wall 76 of base 16. The rear wall 76 may have additional seal means, if desired. Hinge 60 is preferably constructed such that rear seal wall 62 is resiliently urged into continuous contact with the seal wall 76 for all normal positions of the lid 14. This sealing action prevents product contamination and undesired escape.

The preferred living hinge construction of hinge 60 is shown clearly in FIG. 4. Approaching the hinge 60, the thickness of the top wall 26 of lid 14 is reduced on each side of the hinge by beveled edges 78, 80 extending inward from the lower surface of the wall 26. This reduction of the wall thickness permits the seal segment 62 to bend clockwise (FIG. 4) without producing excessive stress on hinge 60. The hinge is a region where the thickness of top wall 26 is sufficiently reduced that the plastic material in that region bends elastically and repeatedly without damage. The preferred thickness of the hinges depends on the plastic material used for construction.

Figure 7:
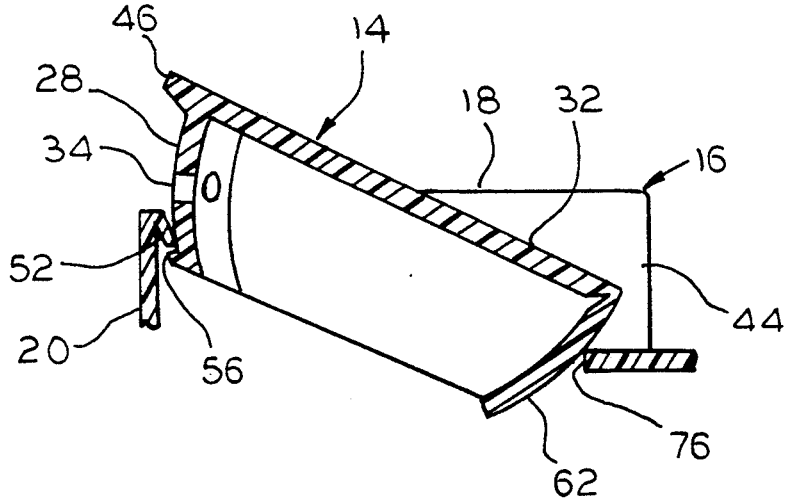
FIG. 7 is a partial cross-sectional view of the container taken along lines 7—7 of FIG. 1 showing the dispensing lid in a partial open position.
Figure 8:
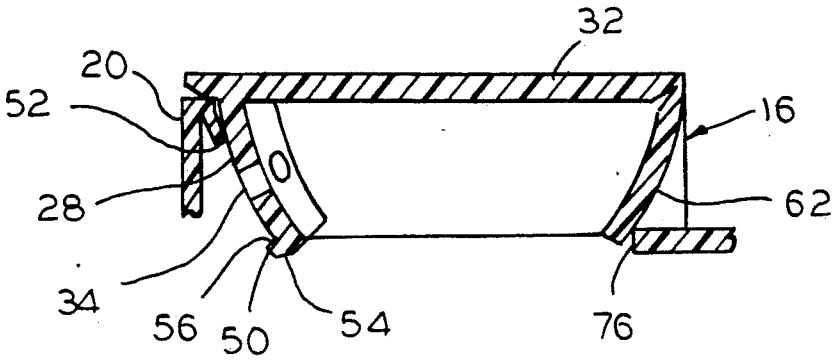
FIG. 8 is a partial cross-sectional view similar to FIG. 7 showing the dispensing lid in a closed position.

As shown in FIGS. 7 and 8, the shape of the rearmost edges of ribs 58 are preferably selected to match the shape of rear seal wall 62, thereby forcing seal segment 62 into reinforcing contact with ribs 58 and in sealing contact with rear seal wall 76. The lid 14 resides in a cavity 42 in the base 16. Base interior side walls 44 extend downward to guide the rear section of lid portion 14 as it pivots and to prevent escape of product from the gap which would form between top walls 26 and 18 if not for side walls 44.

Base 16 is typically installed on a mating cylindrical container 12. Second outer wall 22 surrounds the upper exterior wall of the container 12. In order to retain the base 16 on the container once installed, second outer wall 22 includes an interior lip 82 of approximately triangular cross section which mates with a corresponding lip or groove on the exterior of the container wall. Lip 82 and the mating container lip or groove preferably extend the entire circumferences of the base portion 16 and container 12 respectively to provide a joining and sealing function. An extension 84 of base portion first outer wall 20 depends downward from intermediate wall 24, forming a cavity 86 for the uppermost section of the container wall. Extension 84 is a plug seal which enters into and has sealing contact with the inner diameter of a container neck. Extension 84 includes a beveled exterior edge 88 to facilitate assembly of the cup onto the container.

It will therefore be seen from the above embodiments that this invention provides an improved closure cap adapted for conveniently dispensing particulate, granular, or powdered products. A pivotal lid of the cap may be operated to its open and closed positions using only one hand. No prying or tools are required to open the cap. The cap may be economically produced from plastic as a single piece. A short transport path with a minimum of obstructions minimizes product compaction and clogging of the cap dispensing orifices.

While a preferred embodiment of the invention has been shown, modifications and changes may become apparent to those skilled in the art which shall fall within the spirit and scope of the invention. It is intended that such modifications and changes be covered by the attached claims.

We claim:

1. A one-piece molded plastic press-open side dispensing closure for a container comprising:

a body having a top end wall, a skirt bounding said top wall and said skirt having internal means to attach said closure to the container;

a relatively large aperture formed in said top wall to permit dispensing of a non-liquid product carried in the container;

a press-open dispensing lid pivotally connected to said top wall to open and close said aperture, said pivotal dispensing lid having a front dispensing section and a rear press-open section;

a flexible rear seal wall extending from said press-open section; said seal wall being biased to flex in a direction towards a top surface of said lid, and said flexible rear seal wall being of a predetermined length and normally being in sealing engagement with a corresponding portion of said dispensing aperture.

2. The closure of claim 1 having an arcuate dispensing wall extending downwardly from the under surface of the dispensing lid for a predetermined distance, a plurality of dispensing orifices formed in said dispensing wall, and a flexible cantilevered seal positioned adjacent to and in sealing contact with said arcuate dispensing wall.

3. The closure of claim 2 wherein said cantilever seal extends at an angle of from about 10° to about 45° from a vertical axis.

4. The closure of claim 2 wherein said pivotal lid is pivotally connected to said top wall by a pair of living hinges, said dispensing lid having a pair of curved side walls depending from said front dispensing section and extending from said arcuate dispensing wall, and said curved side walls being in sealing engagement with said aperture.

5. A one-piece molded plastic press-open side dispensing closure for a container comprising:

a body having a top end wall, a skirt bounding said top wall and said skirt having internal means to attach said closure to the container;

a relatively large aperture formed in said top wall to permit dispensing of a non-liquid product carried in the container;

a press-open dispensing lid pivotally connected to said top wall to open and close said aperture, said dispensing aperture formed in said lid being substantially the same shape as said dispensing lid, a top surface of said top wall and a top surface of said dispensing lid being substantially in the same plane when said dispensing lid is in a closed position, said pivotal dispensing lid having a front dispensing section and a rear press-open section;

said front dispensing section having a curved front end and two diverging sides diverging from said front end to outer ends of a pair of living hinges positioned diametrically opposite each other, said rear press-open section having a pair of converging lid sides converging from inner ends of said hinges to a rear end of the press-open section, a flexible curved seal end wall extending from the rear end of the press-open section, said seal end wall being biased to flex in a direction towards said top surface of said lid, said flexible seal end wall being of a predetermined length and normally being in sealing engagement with a corresponding portion of said dispensing aperture, a pair of side walls depending from said top wall into the dispensing aperture adjacent said rear press-open section converging side walls, an arcuate dispensing wall extending downwardly from the under surface of the dispensing lid for a predetermined distance, a plurality of dispensing orifices formed in said dispensing wall, a pair of dispensing curved walls extending downwardly for a predetermined distance from said diverging side walls, said curved side walls also extending from said arcuate dispensing wall, and a flexible cantilevered seal positioned adjacent to and in sealing contact with said arcuate dispensing wall.

6. The closure of claim 5 wherein said pair of side walls depending from said top wall have a flexible curved surface depending from said top wall to provide a seal with said converging lid side walls, and said flexible cantilevered seal extends at an angle to a vertical axis of from about 10° to about 45°.

7. The closure of claim 6 wherein said cantilevered seal is also adjacent to and in sealing contact with said dispensing curved walls.

* * * * *